United States Patent [19]

Clough et al.

[11] Patent Number: 4,698,961

[45] Date of Patent: Oct. 13, 1987

[54] FIBRE-OPENING UNIT FOR AN OPEN-END SPINNING UNIT

[75] Inventors: Douglas O. Clough, Rossendale; Stephen W. Yates, Bolton, both of England

[73] Assignee: Hollingsworth (U.K.) Ltd., Accrington, England

[21] Appl. No.: 882,318

[22] Filed: Jul. 7, 1986

[51] Int. Cl.[4] ..... D01H 13/22; D01H 13/14; D01H 7/892

[52] U.S. Cl. ..... 57/405; 57/83; 57/264

[58] Field of Search ..... 57/78, 81, 83, 90, 92, 57/100, 261, 263, 264, 400, 401, 405, 408, 411, 412

[56] References Cited

U.S. PATENT DOCUMENTS

| | | | |
|---|---|---|---|
| 2,069,118 | 1/1937 | Seem | 57/83 |
| 2,220,024 | 10/1940 | Pool | 57/405 X |
| 3,375,649 | 4/1968 | Bures et al. | 57/83 X |
| 3,568,425 | 3/1971 | Zegna et al. | 57/83 X |
| 3,678,673 | 7/1972 | Prochazka et al. | 57/78 X |
| 3,685,270 | 8/1972 | Bartling | 57/405 |
| 4,163,358 | 8/1979 | Takeuchi et al. | 57/263 X |
| 4,222,225 | 9/1980 | Stahlecker et al. | 57/263 |

*Primary Examiner*—Donald Watkins
*Attorney, Agent, or Firm*—Cort Flint

[57] ABSTRACT

Drive to the sliver feed roll of a fibre-opening unit of an open-end spinner is interrupted by de-activation of a clutch and simultaneously further rotation of the input shaft of a worm and pinion mechanism is blocked against further rotation by release of a spring finger into the path of peripheral teeth on a disc.

Upon a yarn break sensed by a detector, the clutch is de-energized and the spring finger released to arrest and lock the disc.

9 Claims, 1 Drawing Figure

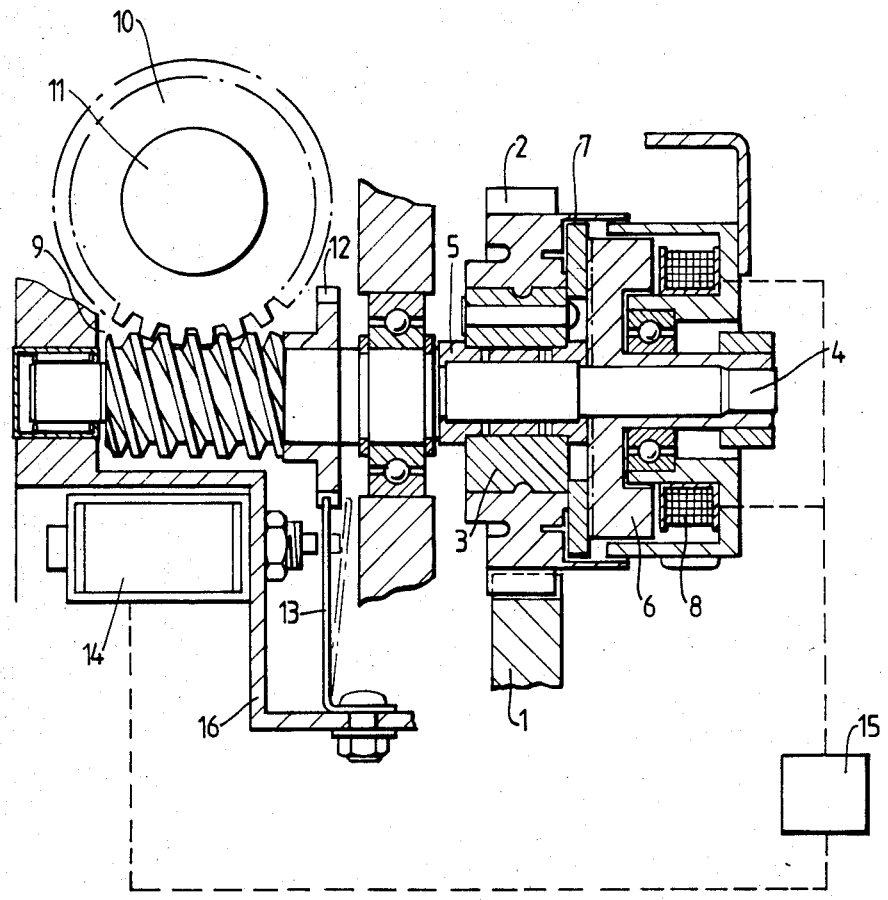
10
11
9
12
5
2
7
4
3
6
8
13
14
16
1
15

FIBRE-OPENING UNIT FOR AN OPEN-END SPINNING UNIT

FIELD OF THE INVENTION

The present invention relates to a fibre-opening unit for an open-end spinner.

PRIOR ART

In open-end spinning, for example rotor spinning or friction spinning, a fibrous sliver is fed to a rapidly rotating toothed wheel, the so-called beater roll, to be opened and converted into discrete fibres which are then entrained in an airstream along a fibre feed duct towards the spinning location. In the case of a rotor spinner the airborne fibres land on the fibre-collecting groove inside the rapidly rotating rotor, and in the case of a friction spinner they land on a moving surface which imparts a rolling movement to the landing bundle of fibres to give the desired twist.

In the event of a yarn break at the open-end spinning unit the supply of sliver to the beater stops, to avoid continuing build-up of fibres at the spinning unit without any chance of them being withdrawn by the delivery rolls. It is customary for the interruption of sliver feed to be achieved by declutching the feed roller which presents the sliver to the beater roll.

It is known that there is a tendency for some fibres to be fed during the shut-down period following interruption of sliver feed during a yarn break, and customarily this is tolerated but overcome by cleaning the fibres from the spinning unit before re-piecing.

OBJECT OF THE INVENTION

It is an object of the invention to discontinue feeding fibres in the absence of yarn withdrawal, firstly because this creates unnecessary contamination of the spinning unit, and secondly because there could in the extreme case be a fire risk due to the accumulation of combustible fibre material.

SUMMARY OF THE INVENTION

Accordingly, the present invention proposes positive braking of the sliver feed roller in order to avoid any possibility of over-run of the sliver feed roller after declutching, and to eliminate any possibility of the continuing engagement of the beater roll with the leading end or fringe of the sliver dragging the sliver forwards and entraining rotation of the feed roller.

Preferably the braking action is applied simultaneously with the signal to interrupt rotation of the sliver feed roller, normally in response to a signal from the yarn detector.

Although we have indicated above that it is conventional to cease driving the feed roller by declutching drive to that feed roller, the present invention can be applied where any other form of de-activation of the sliver feed roller is used, for example de-energisation of a motor driving the feed roller of a particular spinning unit.

BRIEF DESCRIPTION OF THE DRAWING

In order that the present invention may more readily be understood the following description is given, merely by way of example, with reference to the accompanying drawing in which the sole Figure shows a sectional view of the drive to a feed roller of one spinning unit of a multi-station open-end spinning machine.

DESCRIPTION OF THE PREFERRED EMBODIMENT

Drive to the sliver feed rollers of all the spinning units is by way of a main layshaft extending along the machine, driven by a drive source such as an electric motor. Along the layshaft is a set of gears, one gear for each spinning unit, and in the drawing one such gear, appropriate to the particular spinning unit being illustrated, is shown at 1.

The layshaft gear 1 is in constant mesh with a main feed gear 2 of the particular spinning unit, and this latter gear 2 is pressed on a boss 3 which is rotatable relative to its shaft 4 by way of a journal bearing 5.

At the right hand end of the shaft 4 is a clutch member 6 which is axially movable into and out of engagement with an annular friction lining 7 under the influence of clutch-operating electromagnets 8. When the clutch member 6 moves leftwardly, drive is established with the main feed gear 2 and hence the shaft 4, on which the clutch member 6 is keyed, is driven for rotation and will in turn rotate a worm 9 in mesh with a pinion 10 driving the sliver feed roller 11.

In order to ensure that while the open-end spinning unit is shut down there is no creep of the sliver past the feed roller 11, a locking disc 12 is mounted on the shaft 4 so as to be non-rotatable relative thereto and the disc 12 has peripheral teeth and alternating interstices into which the lip of a leaf spring locking tooth member 13 can move when released by a solenoid 14. The opposite end of the tooth member 13 is clamped to the frame 16 of the opening unit.

Both the solenoid 14 and the clutch-operating magnets 8 are linked to a yarn detector, schematically illustrated at 15.

In use of the spinning unit associated with the drive shown in the drawing, during the start-up phase but before piecing occurs the beater roll (not shown) will be in constant rotation along with the beater rolls of all the other spinning units of the same machine, driven for example on a common shaft, or by a flat belt drive, extending along the full length of the machine. At this point the spring tooth member 13 will be in the solid line position shown in the drawing.

To initiate piecing, a yarn detector override switch (not shown) will energise the clutch-operating magnets 8 and the solenoid 14 and this will both displace the tooth member 13 into its broken line position to release the disc 12 and the shaft 4 for rotation, and at the same time initiate drive by connecting the clutch member 6 drivingly to the main feed gear 2.

Once piecing has occurred, the yarn detector override switch becomes inoperative since the detector 15 will then indicate the presence of yarn between the doffing tube and the yarn winder and drive will be maintained.

In the even of a yarn break, the yarn detector 15 will operate to de-energise the solenoid 14 and the clutch-operating magnets 8 so that simultaneously drive to the shaft 4 is interrupted and the spring tooth 13 is liberated from its broken line position to move into engagement with one of the interstices of the disc 12, to lock the shaft 4 and the worm 9 against rotation.

It will of course be understood that the embodiment of the invention shown in the drawing is only one form of the invention as defined in the claims, and that any other type of drive-preventing mechanism will suffice to arrest the pinion 10. For example, whereas in the illustrated embodiment the operation of the feed roller 11 is blocked by locking the shaft 4 which rotates at a higher angular velocity than the feed roller itself, it would alternatively be possible to interrupt rotation by blocking the feed roller shaft. However, it is more convenient to act on the input shaft 4 since this transmits a lower torque which therefore lends itself to more effective braking by the spring finger 13.

We claim:

1. A fibre-opening unit for an open-end spinning unit, comprising:

(a) a sliver feed roll;

(b) means for transmitting drive to the sliver feed roll;

(c) means in the drive transmitting means for interrupting drive to the sliver feed roll;

(d) movable means for movement from an out-of-the-way position to an operative position in which it engages said drive transmitting means to block rotation of the sliver feed roll; and (e) means responsive to operation of said drive interrupting means for moving the movable blocking means to its said operative position when said drive-interrupting means operate to interrupt drive to said sliver feed roll.

2. A fibre-opening unit according to claim 1, including common means for effecting the drive interruption and application of the rotation blocking effect, simultaneously.

3. A fibre-opening unit according to claim 1, wherein the means for interrupting drive to the sliver feed roll comprises an electrically-actuated clutch, and wherein the means for blocking rotation of the sliver feed roll includes a solenoid-operated locking mechanism.

4. A fibre-opening unit according to claim 3, including a yarn detector, and means for connecting said clutch and said solenoid to said yarn detector.

5. A fibre-opening unit according to claim 1, wherein the rotation-blocking mechanism includes a peripherally toothed disc and a member movable into and out of the toothed periphery of the disc whereby during normal driven rotation of the sliver feed roll the movable member is clear of the path of the peripheral teeth of the disc, and when rotation is to be blocked the said movable member moves into the path of the peripheral teeth of the disc.

6. A fibre-opening unit according to claim 5, wherein said movable member comprises a spring finger having a first end clamped to a stationary component of the fibre-opening unit, and a second end resiliently movable under the influence of a solenoid which is energised to hold the spring clear of the path of the disc teeth and de-energised to allow the spring to return to a relaxed condition in which it lies in the path of the disc teeth.

7. A fibre-opening unit for an open-end spinning unit, comprising:

(a) a sliver feed roll;

(b) means for transmitting drive to the sliver feed roll, said drive transmitting means including a worm and pinion arrangement with the sliver feed roll coaxial with the pinion;

(c) means in the drive transmitting means for interrupting drive to the shaft of the worm;

(d) movable means for movement from an out-of-the-way position to an operative position in which it engages said drive transmitting means to block rotation of the shaft of the worm; and (e) means responsive to operation of said drive-interrupting means for moving the movable blocking means to its said operative position when said drive-interrupting means operate to interrupt drive to the shaft of the worm.

8. A fibre-opening unit for an open-end spinning unit, comprising:

(a) a sliver feed roll;

(b) means for transmitting drive to the sliver feed roll;

(c) means in the drive transmitting means for interrupting drive to the sliver feed roll;

(d) a peripherally toothed disc in said drive-transmitting means and arranged to rotate with the transmission of drive by said drive-transmitting means;

(e) a member movable into and out of the toothed periphery of the disc for blocking rotation thereof, whereby during normal driven operation of the sliver feed roll the movable member is clear of the path of the peripheral teeth of the disc, and when rotation is to be blocked the said movable member moves into the path of the peripheral teeth of the disc; and (f) means responsive to operation of the drive-interrupting means for moving said member into the path of the peripheral teeth of the disc when drive is interrupted.

9. A fibre-opening unit according to claim 8, wherein said movable member comprises a spring finger having a first end clamped to a stationary component of the fibre-opening unit, and a second end resiliently movable under the influence of a solenoid which is energised to hold the spring clear of the path of the disc teeth and de-energised to allow the spring to return to a relaxed condition in which it lies in the path of the disc teeth.

* * * * *